US008920224B2

(12) United States Patent
Pucciani

(10) Patent No.: US 8,920,224 B2
(45) Date of Patent: Dec. 30, 2014

(54) BLOWER ENCLOSURE

(75) Inventor: Allen S. Pucciani, Beavercreek, OH (US)

(73) Assignee: Illinois Tool Works Inc, Glenview, IL (US)

( * ) Notice: Subject to any disclaimer, the term of this patent is extended or adjusted under 35 U.S.C. 154(b) by 945 days.

(21) Appl. No.: 11/545,244

(22) Filed: Oct. 10, 2006

(65) Prior Publication Data

US 2008/0113598 A1 May 15, 2008

(51) Int. Cl.
*F04D 29/42* (2006.01)
*F04D 29/60* (2006.01)
*F04D 29/66* (2006.01)

(52) U.S. Cl.
CPC ..... *F04D 29/601* (2013.01); *F04D 29/663* (2013.01)
USPC ..... 454/56

(58) Field of Classification Search
CPC ..... F04D 29/601; F04D 29/603
USPC ..... 454/56, 58, 59, 61, 184
See application file for complete search history.

(56) References Cited

U.S. PATENT DOCUMENTS 3,314,385 A * 4/1967 Brucken et al. ..... 110/191
3,716,967 A * 2/1973 Doyle et al. ..... 96/407
4,544,023 A * 10/1985 Marciniak ..... 165/48.1
4,657,292 A * 4/1987 Bruck ..... 292/80
4,805,353 A * 2/1989 Keith et al. ..... 451/456
4,886,081 A * 12/1989 Blaul ..... 134/18
5,036,677 A * 8/1991 Neuenfeldt et al. ..... 62/259.1
5,216,840 A * 6/1993 Andrews ..... 49/483.1
5,273,060 A * 12/1993 Hill et al. ..... 134/57 R
5,678,583 A * 10/1997 Conroy et al. ..... 134/133
5,882,404 A * 3/1999 Gummer ..... 118/70
5,913,354 A * 6/1999 Conroy et al. ..... 164/131
6,099,607 A * 8/2000 Haslebacher ..... 55/356
6,368,206 B1 * 4/2002 Hunter et al. ..... 454/58
6,644,049 B2 * 11/2003 Alford ..... 62/173
2003/0077169 A1 * 4/2003 Rosenthal et al. ..... 415/201
2005/0098114 A1 * 5/2005 Christensen ..... 118/719
2005/0284167 A1 * 12/2005 Morgan et al. ..... 62/272

* cited by examiner

*Primary Examiner* — Kang Hu
*Assistant Examiner* — Samantha Miller
(74) *Attorney, Agent, or Firm* — Joseph M. Butscher; The Small Patent Law Group, LLC

(57) ABSTRACT

Embodiments of the present invention provide a blower enclosure configured to secure to a base and house a blower. The blower enclosure includes a main body defining an internal blower chamber, and at least one access door configured to open to allow access to the blower. The enclosure may also include a gland plate secured over a preformed opening in the main body. The gland plate may include an O-ring configured to sealingly engage an outlet pipe of the blower. The enclosure may further include a fixed filter shroud configured to allow a user to install and remove a filter element without the use of a tool.

24 Claims, 6 Drawing Sheets

BLOWER ENCLOSURE

FIELD OF THE INVENTION

Embodiments of the present invention generally relate to a blower assembly, and more particularly to an enclosure for a blower assembly.

BACKGROUND OF THE INVENTION

Centrifugal blowers are used with various applications. For example, centrifugal blowers may be used to power an air knife that may be used to remove moisture and debris from products and packaging. After the moisture and debris has been removed, date codes and other information may be printed on the products and packaging.

Typically, a centrifugal blower is housed in a protective enclosure. The protective enclosure protects the blowers from moisture and debris. After the blower assembly is used, the assembly area may be washed down. The enclosure protects the blower from the wash fluid. Additionally, the enclosure may dampen or otherwise minimize the sound created by an operating blower.

A conventional blower enclosure includes front, rear, top, and lateral walls integrally formed with one another. The bottom of the enclosure is open ended. The five sided enclosure is typically lowered onto a steel frame and is secured through mounting brackets. In particular, the enclosure is secured to the frame through screws or bolts. Seams are formed at the union of the lateral, front, and rear walls and the frame. The seams may provide a path for moisture to infiltrate into the interior chamber of the enclosure where the blower resides.

In order to service the blower, motor, and/or filters contained within the enclosure, an operator typically unfastens the bolts or screws that secure the enclosure to the frame, and removes the enclosure from the frame. That is, the operator engages each fastener with a tool, such as a screwdriver, ratchet, wrench, or the like. Additionally, before removing the enclosure, outlet pipes are removed. Servicing the blower and other components in this manner may take a substantial amount of time.

Other types of enclosures include an access door that is secured via screws. The access door is proximate a filter element within the blower assembly. In order to change the filter element, an operator unscrews the fasteners, and opens the door to gain access to the filter element. However, the access door does not provide access to the blower or motor. In order to service the blower or motor, the entire enclosure typically is removed from the base.

Additionally, during assembly of the blower assembly, an opening is cut or formed through the enclosure. An outlet pipe configured to be attached to the blower is secured through the outlet. For example, a typical outlet pipe includes a flange configured to secure to the enclosure. A plurality of gaskets are positioned around the tube before it is passed through the opening. The gaskets abut against the enclosure around the opening in order to provide a seal. The process of cutting a hole through the enclosure for the outlet pipe provides another step for an operator to perform during the overall installation process.

Thus, a need exists for a blower enclosure that provides quick and easy access to the blower and other components. A need also exists for a system and method of quickly and easily servicing a blower and components within blower enclosure.

SUMMARY OF THE INVENTION

Certain embodiments of the present invention provide a blower enclosure or cover configured to secure to a base and house a blower. The blower enclosure may include a main body defining an internal blower chamber, and at least one access door configured to open to allow access to the blower. Access to the blower may be gained without removing the blower enclosure from the base.

The access door allows access to the internal chamber when the access door is in the open position. The access door and the main body provide a fluid-tight barrier when the access door is in the closed position.

The enclosure may include two access doors, wherein a first of the access doors is positioned on a first side of the main body, and a second of the access doors is positioned on a second side of the main body. The second side may be opposite the first side. For example, the first side may be the front side, while the second side may be the rear side.

The enclosure may also include at least one fixed filter shroud that includes at least one guide rib configured to guide a pre-filter into position, a groove located between the guide rib and the main body, and a retaining clip. The pre-filter is securely retained by the groove and the retaining clip. An open end of the shroud provides access to the pre-filter.

Certain embodiments of the present invention also provide a blower assembly including an air blower, a motor, and a cover. The air blower includes an air outlet tube, and is operable to force air through the air outlet tube. The motor is operatively connected to the air blower. The cover may include a main body defining an internal blower chamber, at least one access door secured to the main body and selectively moveable between open and closed positions. The air blower and the motor are housed within said main body, and the access door provides access to the air blower and the motor when the access door is in the open position.

Figure 1:
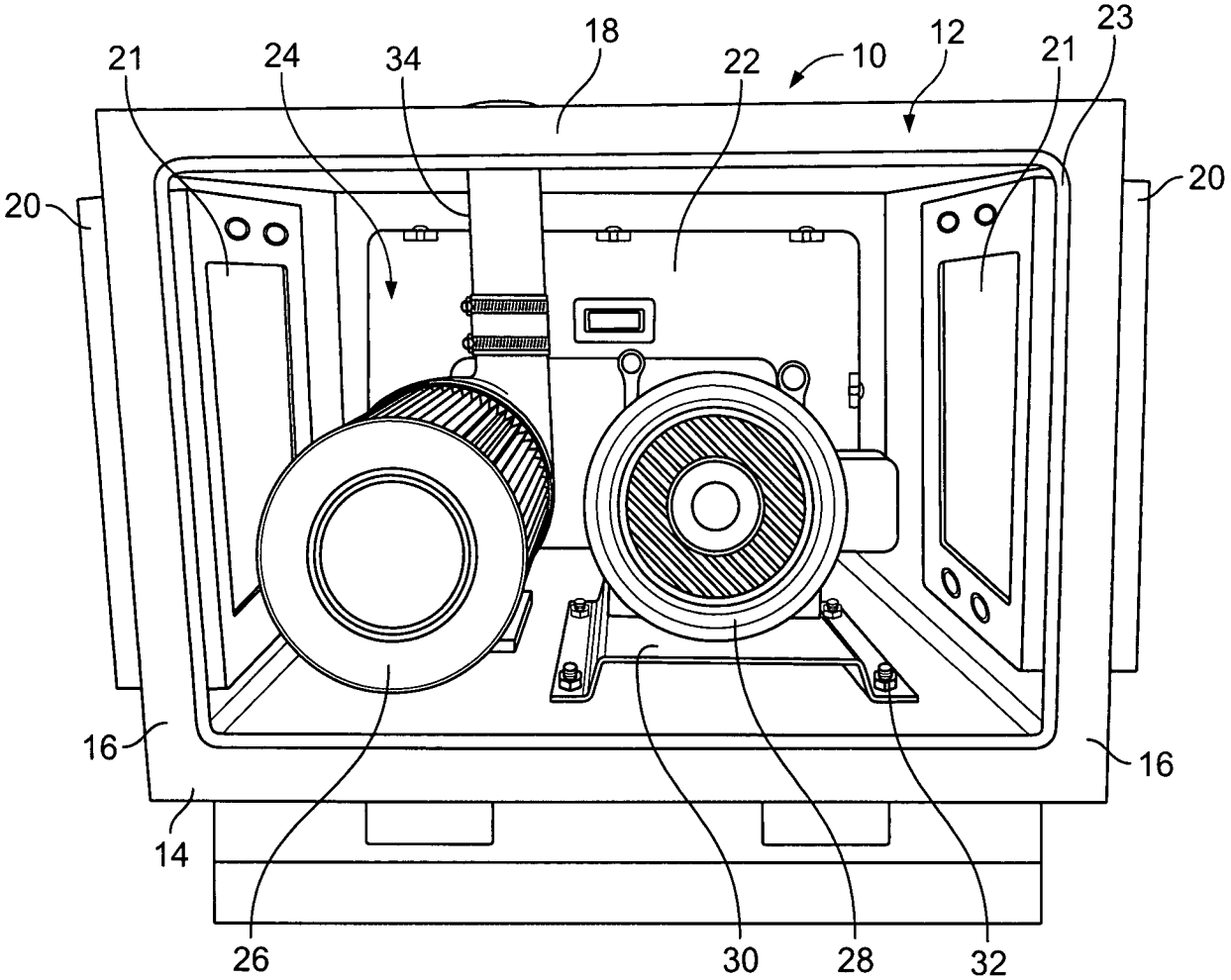
FIG. 1 illustrates an isometric front view of a blower assembly according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 illustrates an isometric front view of a blower assembly 10 according to an embodiment of the present invention. The blower assembly 10 includes a blower enclosure or cover 12 having a bottom wall 14 integrally formed with lateral walls 16, which are in turn integrally formed with a top wall 18. Filter shrouds 20 outwardly extend from each lateral wall 16. The bottom ends of the filter shrouds 20 are open. Mesh pre-filters 21 are configured to be secured within the filter shrouds 20. The pre-filters 21 are configured to trap large airborne particulates.

The blower enclosure 12 also includes front and rear access doors 22. In order to show the internal components of the blower assembly 10, the front access door is not shown in FIG. 1. Internal grooves 23 configured to receive and retain the access doors 22 are formed between the bottom, lateral, and top walls 14, 16, and 18 on the front and rear of the enclosure 12. The access doors 22 and the grooves 23 cooperate with one another to provide a seamless, water-tight union. For example, the interior surfaces of the access doors 22 may include sealing gasket members around their edges.

The walls 14, 16, and 18, and the access doors 22 define an internal chamber 24. A centrifugal blower 26 and a motor 28 are secured within the internal chamber 24. The blower 26 and the motor 28 may be secured to an interior surface of the bottom wall 14 through brackets 30 and fasteners 32. The blower 26 may be operatively connected to the motor 28 through belts, pulleys, and the like (not shown).

The blower 26 is, in turn, operatively connected to an outlet pipe 34 that is configured to deliver air from the blower 26 out of the blower assembly 10. As shown in FIG. 1, the outlet pipe 34 passes through the top wall 18 of the enclosure 12. Alternatively, the outlet pipe 34 may pass through the bottom wall 14.

The enclosure 12 may be formed of polypropylene and may be secured to a steel base. The enclosure 12 protects the blower 26, the motor 28, and the filters 21 in wash-down environments and reduces sound levels to within OSHA standards. The access doors 22 may be formed of clear Lexan.

Figure 2:
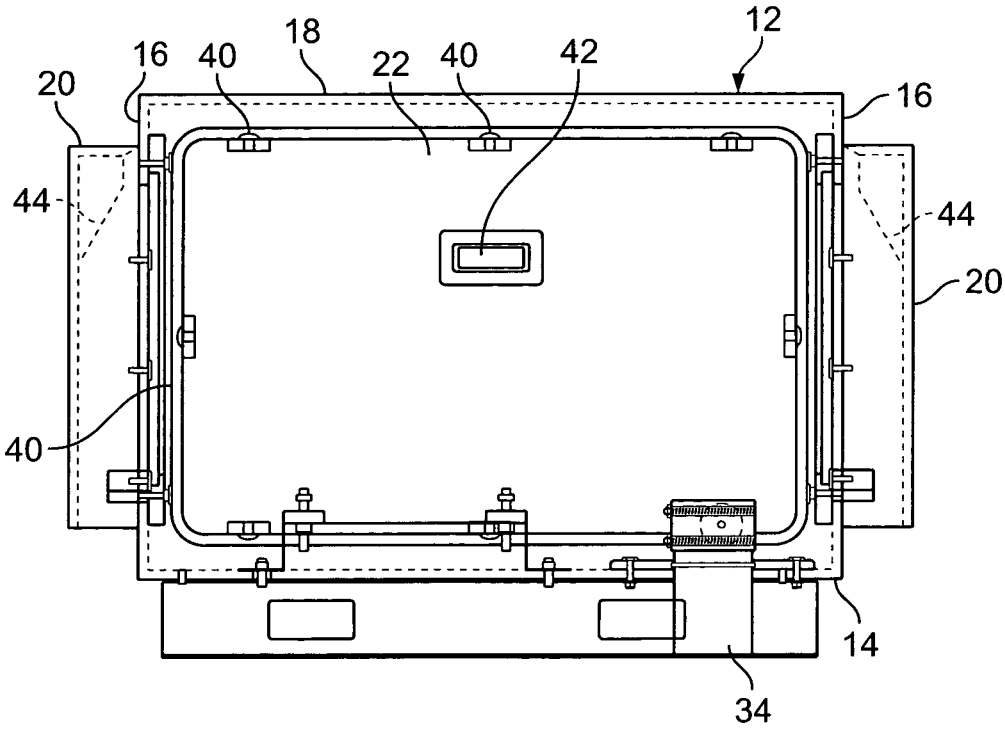
FIG. 2 illustrates a front elevation view of a blower enclosure according to an embodiment of the present invention.

FIG. 2 illustrates a front elevation view of the blower enclosure 12. As shown in FIG. 2, the outlet pipe 34 extends through the bottom wall 14 of the enclosure 12. The access doors 22 are secured to grooves (not shown in FIG. 2) formed in the enclosure 12. Each access door 22 is secured within the grooves through a plurality of spring actuator fasteners 40. Each spring actuator fastener 40 may be a spring cam mechanism that may be quickly and easily engaged. For example, the spring actuator fasteners 40 may be half turn, fast lock fasteners.

In order to gain access to the interior of the blower enclosure 12, a user simply engages the spring actuator fasteners 40 in order to remove the access door 22. Each access door 22 may also include a graspable handle 42. Thus, a user disconnects the access door 22 by engaging the spring actuator fasteners 40, and then grasps the access door 22 through the handle 42 in order to remove the access door 22 from the remainder of the enclosure 12.

Because the blower enclosure 12 includes access doors 22 at the front and rear, a user may gain access to the interior of blower enclosure 12 from two distinct areas. Thus, if the blower 26 (shown in FIG. 1) within the blower enclosure 12 needs to be serviced, a user merely opens one or both access doors 22 (instead of completely removing the blower enclosure from a base). The access doors 22 allow the internal components of the blower assembly 10 (shown in FIG. 1) to be serviced without removing or adjusting the outlet pipe 34 and/or other duct work.

While the access doors 22 are shown secured to the walls 14, 16, and 18 through a plurality of spring actuator fasteners 40, the access doors 22 may, alternatively, be configured to slide, rotate (such as through hinges), or swivel open with respect to the blower assembly 10 (shown in FIG. 1). For example, one side of an access door 22 may be operatively connected to a hinge, while the distal end of the access door 22 may lock into place through a latch.

Figure 3:
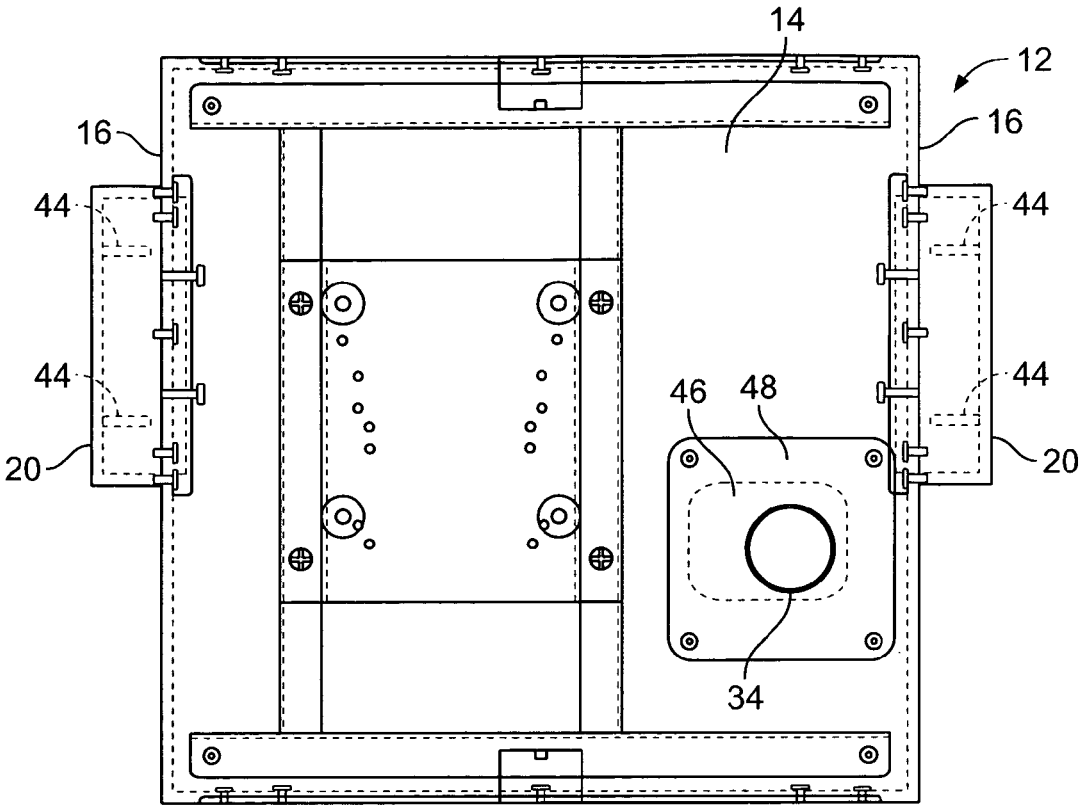
FIG. 3 illustrates a bottom elevation view of a blower enclosure according to an embodiment of the present invention.
Figure 4:
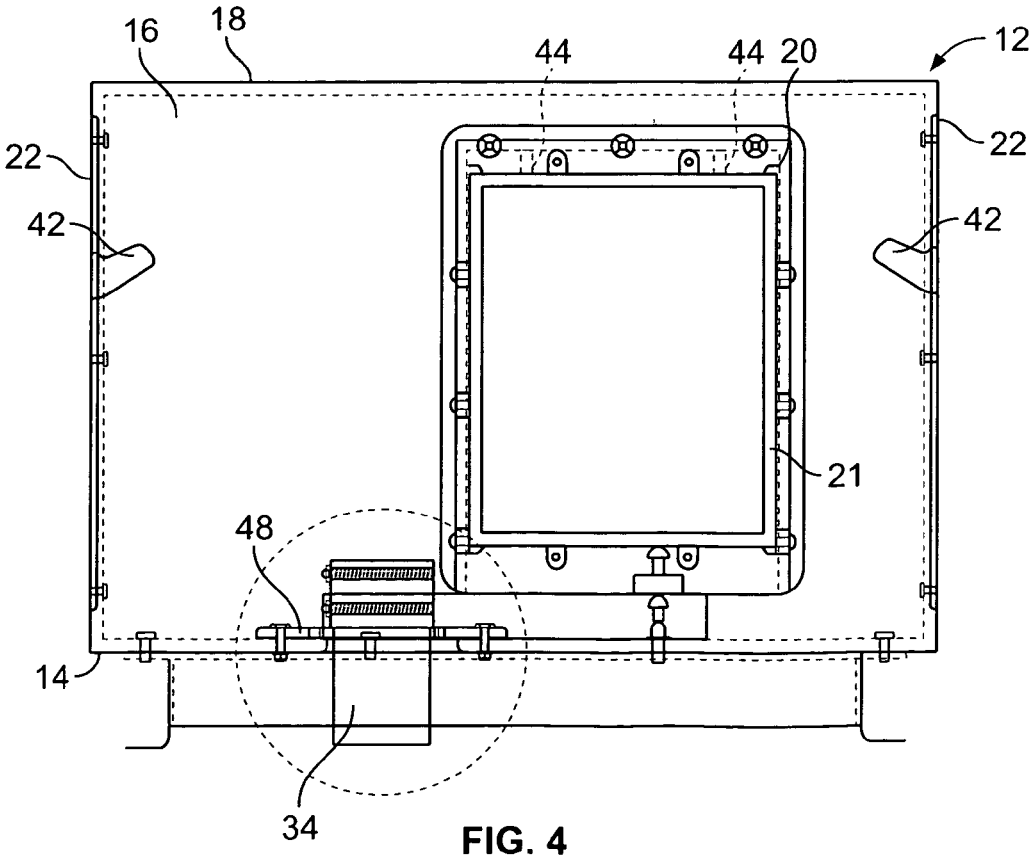
FIG. 4 illustrates a side elevation view of a blower enclosure according to an embodiment of the present invention.

FIGS. 3 and 4 illustrate bottom and side views, respectively, of the blower enclosure 12. As shown in FIGS. 2-4, each filter shroud 20 includes guide ribs 44 that are configured to guide the pre-filters 21 (shown in FIGS. 1 and 4) into a secured position (as discussed below with respect to FIGS. 7-10).

The bottom wall 14 of the enclosure 12 includes a preformed opening 46. Optionally, the preformed opening 46 may be formed through the top wall 18 (shown in FIGS. 1 and 2) depending on the location of the outlet pipe 34. The outlet pipe 34 is sealably secured to a gland plate 48 that is secured over the preformed opening 46.

Figure 5:
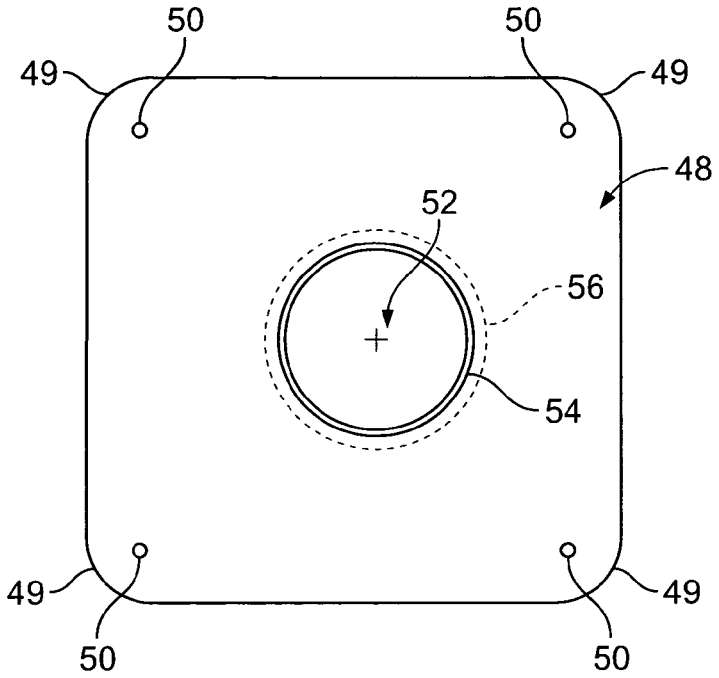
FIG. 5 illustrates a top elevation view of a gland plate according to an embodiment of the present invention.

FIG. 5 illustrates a top elevation view of the gland plate 48. The gland plate 48 is a planar sheet having a rectangular shape with rounded corners 49. Optionally, the gland plate 48 may be various other shapes.

The perimeter and cross-sectional area of the gland plate 48 are both greater than the perimeter and cross-sectional area of the preformed opening 46 (shown in FIG. 3) formed through either the bottom or top wall 14 or 18 of the enclosure 12 (shown in FIGS. 1-4). The gland plate 48 includes fastener through holes 50 proximate each rounded corner 49. The fastener through holes 50 are configured to align with corresponding fastener through holes formed through the bottom or top wall 14 or 18 of the enclosure 12.

An outlet pipe passage 52 is formed through the gland plate 48. A sealing O-ring 54 is secured within the gland plate 48 and extends into the outlet pipe passage 52. The O-ring 54 extends over the circumference of an interior edge 56 that defines the outlet pipe passage 52.

Figure 6:
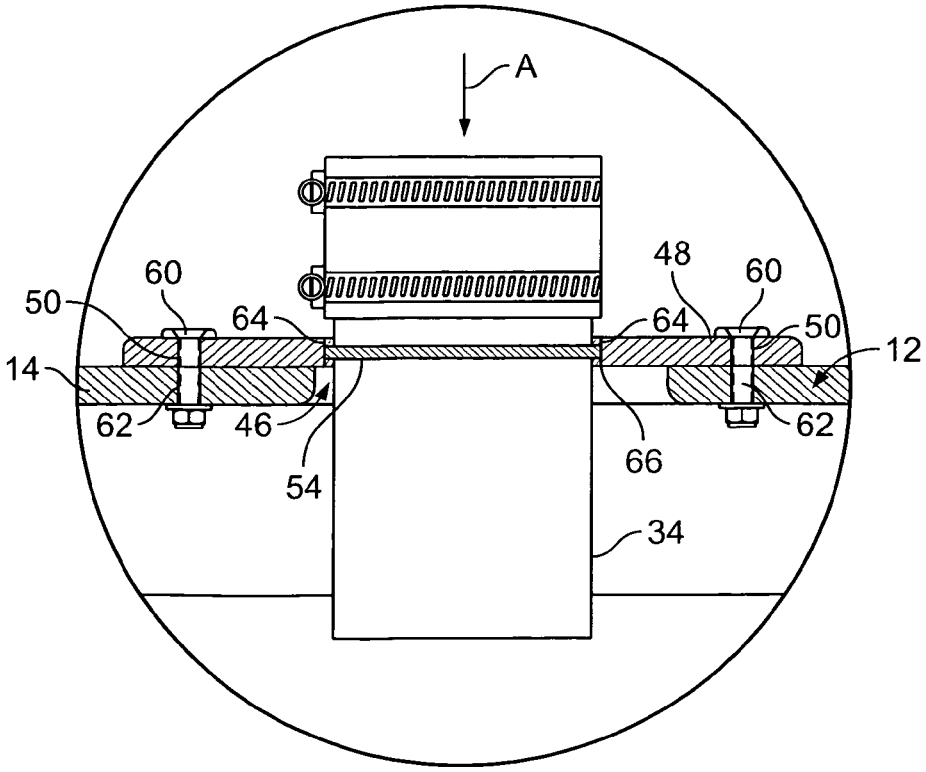
FIG. 6 illustrates a side elevation view of an outlet pipe secured to an enclosure wall through a gland plate according to an embodiment of the present invention.

FIG. 6 illustrates a side elevation view of the outlet pipe 34 secured to the bottom wall 14 of the enclosure 12 through the gland plate 48 The gland plate 48 is positioned over the preformed opening 46 formed through the bottom wall 14 of the enclosure 12. Planar surfaces of the gland plate 48 overlap portions of the bottom wall 14 that bound the preformed opening 46. The gland plate 48 is secured to the bottom wall 14 through fasteners 60 that are positioned within the through holes 50 and the aligned through holes 62 formed through the bottom wall 14.

As shown in FIG. 6, an outer edge 64 of the O-ring 54 is compressively sandwiched within a reciprocal notch 66 formed within the gland plate 48. The outlet pipe 34 is urged into the outlet pipe passage 52 (shown in FIG. 5) in the direction of arrow A. As the outlet pipe 34 is passed through the outlet pipe passage 52, the O-ring 54 sealingly engages the outer surface of the outlet pipe 34, thereby forming a fluid tight barrier. The outlet pipe 34 may be secured to the gland plate 48 before or after the gland plate 48 is secured to the enclosure 12. The gland plate 48 provides a quick and easy way to secure the outlet pipe 34 with respect to the enclosure 12 without cutting an additional hole through the enclosure 12. Moreover, the outlet pipe 34 is sealingly secured to the gland plate 48 through the O-ring 48. Therefore, there is no need for additional gaskets around the outlet pipe 34 on either side of the wall 14.

Figure 7:
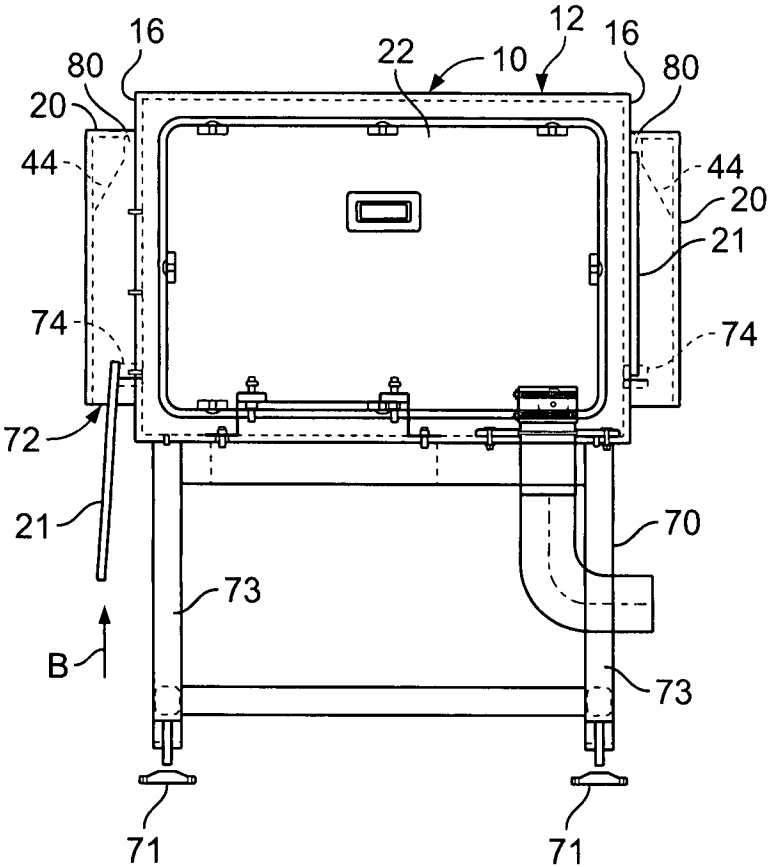
FIG. 7 illustrates a front elevation view of a blower assembly during a first filter installation stage according to an embodiment of the present invention.

FIG. 7 illustrates a front elevation view of the blower assembly 10 during a first filter installation stage according to an embodiment of the present invention. As shown in FIG. 7, the blower enclosure 12 may be secured to a base 70. The base 70 may include adjustable leveling support pads 71. Thus, the height of each support column 73 of the base 70 may be adjusted.

In order to install the pre-filters 21, each pre-filter 21 is urged into the filter shroud 20 through an open bottom end 72 of the filter shroud 20 in the direction of arrow B. A retaining clip 74 is positioned proximate a lower portion of the lateral wall 16 and the open bottom end 72 of the filter shroud 20. Each pre-filter 21 may be configured to be retained by a series of smaller clips 74 or clamps, or a large clip or clamp above and below a pre-filter 21 that spans the entire length of the pre-filter 21.

Figure 8:
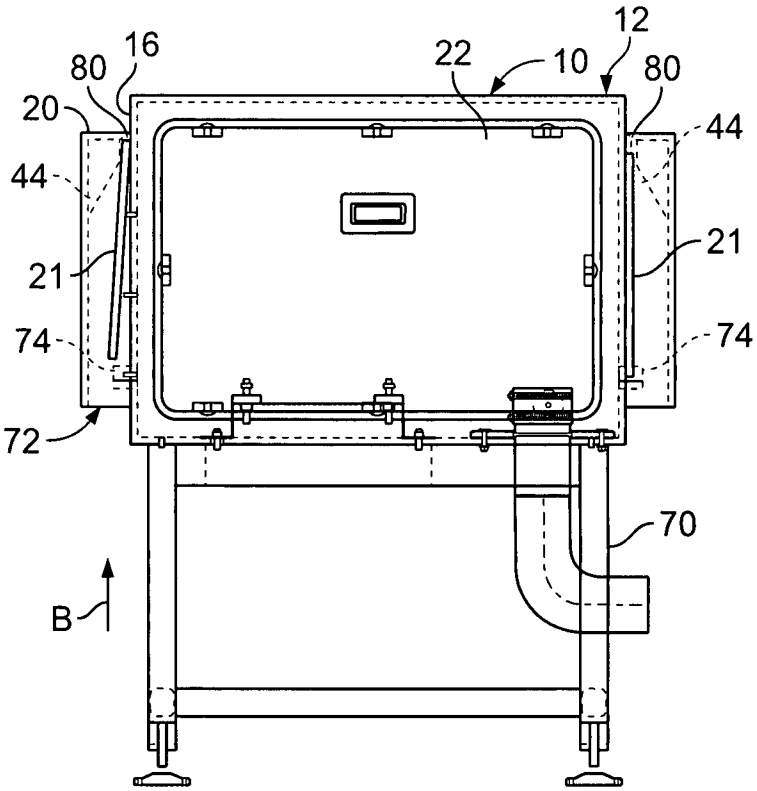
FIG. 8 illustrates a front elevation view of a blower assembly during a second filter installation stage according to an embodiment of the present invention.

FIG. 8 illustrates a front elevation view of a blower assembly 10 during a second filter installation stage according to an embodiment of the present invention. The pre-filter 21 continues to be urged in the direction of arrow B until its bottom end is above the retaining clip 74. During this movement, the angled guide ribs 44 force the top of the pre-filter 21 toward the interior chamber of the enclosure 12 into a groove 80 defined between the lateral wall 16 and the guide ribs 44.

Figure 9:
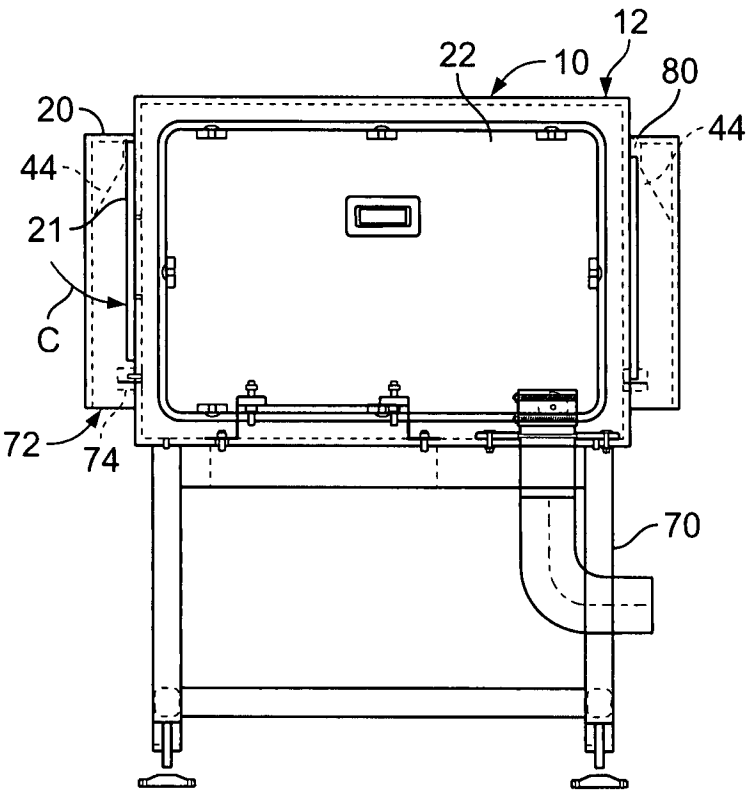
FIG. 9 illustrates a front elevation view of a blower assembly during a third filter installation stage according to an embodiment of the present invention.

FIG. 9 illustrates a front elevation view of the blower assembly 10 during a third filter installation stage according to an embodiment of the present invention. After the bottom end of the pre-filter 21 has cleared the retaining clip 74, the bottom end of the pre-filter 21 is swung in the direction of arrow C about the pivot defined by the top end of the pre-filter 21 positioned within the groove 80.

Figure 10:
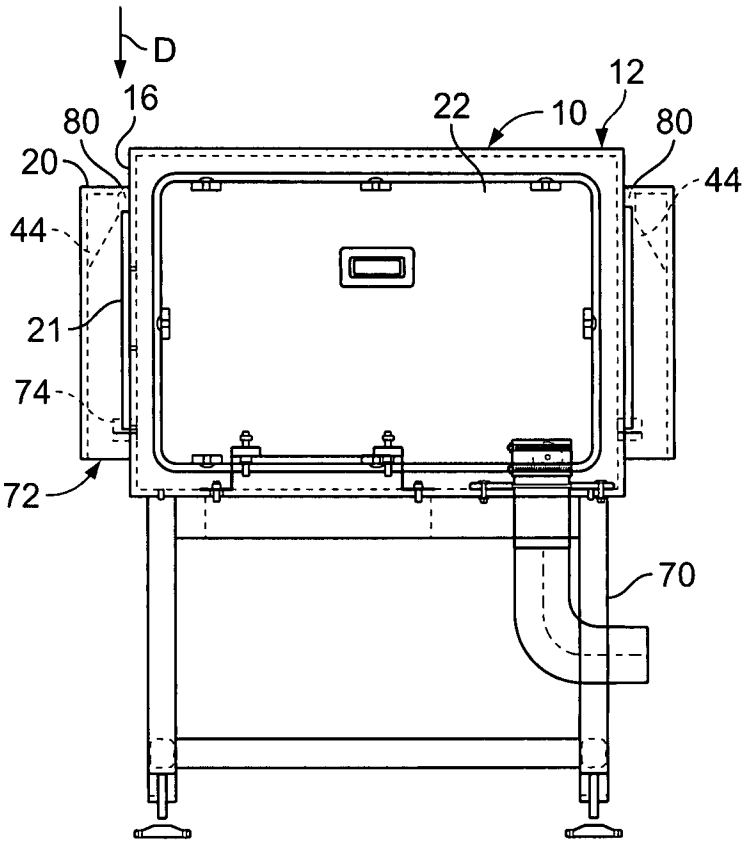
FIG. 10 illustrates a front elevation view of a blower assembly during a fourth filter installation stage according to an embodiment of the present invention.

FIG. 10 illustrates a front elevation view of the blower assembly 10 during a fourth filter installation stage according to an embodiment of the present invention. After the bottom end of the pre-filter 21 is swung into position as shown in FIG. 9, the pre-filter 21 is merely allowed to drop down in the direction of arrow D. As such, the bottom end of the pre-filter 21 is retained by the retaining clip 74, while the top end of the pre-filter 21 is retained within the groove 80 formed between the lateral wall 16 and the guide ribs 44.

In order to remove the pre-filter 21, the process is simply reversed. For example, the secured pre-filter 21 is pushed upward so that it disengages from the retaining clip 74. The bottom end of the pre-filter 21 is then swung away from the internal chamber of the enclosure 12. At this point, the pre-filter 21 may then be removed from the filter shroud 20 through the open bottom end 72.

Thus, the blower enclosure 10 provides a quick and easy system and method of changing pre-filters 21. The pre-filters 21 may be changed without the use of tools, and without removing the enclosure 12 from the base. In fact, the pre-filters 21 may be changed without opening an access door 22.

Thus, embodiments of the present invention provide a blower enclosure that provides quick and easy access to the blower and other internal components. Additionally, embodiments of the present invention provide a system and method of quickly and easily servicing a blower and components within a blower enclosure.

While various spatial terms, such as upper, lower, mid, lateral, horizontal, vertical, and the like may used to describe portions of the blower assembly, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A blower enclosure configured to secure to a base and house a blower, the blower enclosure comprising:

a main body defining an internal blower chamber configured to house an air blower; and two access doors secured to said main body and moveable between open and closed positions, said two access doors allowing direct access to the blower within said internal blower chamber when each of said access doors is in said open position, and said access doors and said main body providing a fluid-tight barrier when each of said access doors is in said closed position, wherein a first of said access doors is positioned on a first side of said main body, and a second of said access doors is positioned on a second side of said main body, wherein said second side is opposite said first side.

2. The blower enclosure of claim 1, wherein access to the internal blower chamber is gained without removing the blower enclosure from the base.

3. The blower enclosure of claim 1, wherein said main body comprises a bottom wall integrally formed with lateral walls, which are in turn integrally formed with a top wall, wherein said internal blower chamber is defined between said bottom, lateral, and top walls.

4. The blower enclosure of claim 1, wherein at least one of said access doors is secured to said main body through a plurality of spring actuator fasteners.

5. The blower enclosure of claim 4, wherein each of said plurality of spring actuator fasteners comprises a spring cam mechanism.

6. The blower enclosure of claim 1, further comprising a gland plate secured over a preformed opening in said main body, said gland plate comprising an O-ring configured to sealingly engage an outlet pipe of the blower.

7. The blower enclosure of claim 1, further comprising at least one fixed filter shroud, said at least one fixed filter shroud comprising:

at least one fixed guide rib configured to guide a pre-filter into position;

a fixed groove located between said at least one guide rib and said main body; and a retaining clip, wherein the pre-filter is securely retained by said groove and said retaining clip.

8. The blower enclosure of claim 7, wherein said at least one fixed filter shroud comprises an open end that provides access to the pre-filter.

9. The blower enclosure of claim 1, wherein said main body prevents moisture and debris from entering said internal blower chamber, and wherein said main body minimizes sound generated within said internal blower chamber.

10. A blower assembly comprising:

an air blower having an air outlet tube, said air blower operable to force air through said air outlet tube;

a motor operatively connected to said air blower; and a cover comprising: (i) a main body defining an internal blower chamber; and (ii) two access doors secured to said main body and moveable between open and closed positions, wherein a first of said access doors is positioned on a first side of said main body, and a second of said access doors is positioned on a second side of said main body, wherein said second side is opposite said first side, said air blower and said motor being housed within said main body, and each of said access doors providing direct access to said air blower and said motor when each of said access doors is in said open position.

11. The blower assembly of claim 10, wherein said main body comprises a bottom wall integrally formed with lateral walls, which are in turn integrally formed with a top wall, wherein said internal blower chamber is defined between said bottom, lateral, and top walls.

12. The blower assembly of claim 10, wherein each of said access doors is secured to said main body through a plurality of spring actuator fasteners.

13. The blower assembly of claim 12, wherein each of said plurality of spring actuator fasteners comprises a spring cam mechanism.

14. The blower assembly of claim 10, further comprising a gland plate secured over a preformed opening in said main body, said gland plate comprising an O-ring configured to sealingly engage said air outlet tube.

15. The blower assembly of claim 10, further comprising at least one fixed filter shroud, said at least one filter shroud comprising:

at least one fixed guide rib configured to guide a pre-filter into position;

a fixed groove located between said at least one guide rib and said main body; and a retaining clip, wherein the pre-filter is securely retained by said fixed groove and said retaining clip.

16. The blower assembly of claim 15, wherein said at least one fixed filter shroud comprises an open end that provides access to the pre-filter.

17. The blower assembly of claim 10, wherein said main body prevents moisture and debris from entering said internal blower chamber, and wherein said main body minimizes sound generated within said internal blower chamber.

18. A blower enclosure configured to secure to a base and house a blower, the blower enclosure comprising:

a main body defining an internal blower chamber;

at least one pre-filter configured to trap airborne particulates; and at least one fixed filter shroud, said at least one fixed filter shroud comprising: (i) at least one guide rib configured to guide said at least one pre-filter into position; (ii) a groove located between said at least one guide rib and said main body; and (iii) a retaining clip, wherein said at least one pre-filter is securely retained by said groove and said retaining clip.

19. The blower enclosure of claim 18, wherein said at least one fixed filter shroud comprises an open end that provides access to said at least one pre-filter, wherein said at least one pre-filter may be secured within, and removed from, said at least one fixed filter shroud without the use of any tools.

20. The blower enclosure of claim 18, wherein said main body comprises a bottom wall integrally formed with lateral walls, which are in turn integrally formed with a top wall, wherein said internal blower chamber is defined between said bottom, lateral, and top walls, and wherein said at least one fixed filter shroud comprises a first fixed filter shroud outwardly extending from a first lateral wall, and a second fixed filter shroud extending from a second lateral wall.

21. The blower enclosure of claim 20, further comprising a first access door removably secured to a first side of said main body, and a second access door removably secured to a second side of said main body.

22. The blower enclosure of claim 21, wherein either of said first and second access doors are configured to open to provide access to the blower.

23. The blower enclosure of claim 18, wherein said at least one guide rib is angled and configured to force a top of said at least one pre-filter toward said main body and into said groove, and wherein a bottom end of said at least one pre-filter is allowed to drop toward said retaining clip so that said top of said at least one pre-filter is securely retained within said groove and said bottom of said at least one pre-filter is securely retained by said retaining clip.

24. The blower enclosure of claim 18, wherein said main body prevents moisture and debris from entering said internal blower chamber, and wherein said main body minimizes sound generated within said internal blower chamber.

* * * * *